United States Patent [19]

Solomon

[11] Patent Number: 4,949,856

[45] Date of Patent: Aug. 21, 1990

[54] SLACKLESS DRAWBAR

[75] Inventor: James E. Solomon, Lithopolis, Ohio

[73] Assignee: Buckeye Steel Castings Co., Columbus, Ohio

[21] Appl. No.: 126,183

[22] Filed: Nov. 27, 1987

[51] Int. Cl.[5] ..... B61G 7/10

[52] U.S. Cl. ..... 213/62 R

[58] Field of Search ..... 213/50, 54, 60, 61, 213/62 R, 67 R, 67 A, 68, 20, 21, 12, 13, 14, 69, 70, 71, 72, 74, 188

[56] References Cited

U.S. PATENT DOCUMENTS

| | | | |
|---|---|---|---|
| 981,746 | 1/1911 | Brown | 213/21 X |
| 2,209,229 | 7/1940 | Kjolseth | 213/14 X |
| 2,737,903 | 3/1956 | McCormick . | |
| 3,480,268 | 11/1969 | Fishbaugh . | |
| 3,587,869 | 6/1971 | Atkinson et al. | 213/50 X |
| 3,709,376 | 1/1973 | Altherr . | |
| 3,716,146 | 2/1973 | Altherr . | |
| 4,236,644 | 12/1980 | DePenti . | |
| 4,236,645 | 12/1980 | DePenti . | |
| 4,336,758 | 6/1982 | Radwill . | |
| 4,422,557 | 12/1983 | Altherr . | |
| 4,531,648 | 7/1985 | Paton . | |
| 4,700,853 | 10/1987 | Altherr et al. | 213/50 |

*Primary Examiner*—Margaret A. Focarino
*Assistant Examiner*—F. Williams
*Attorney, Agent, or Firm*—Allegretti & Witcoff, Ltd.

[57] ABSTRACT

A drawbar assembly for interconnecting railcars comprises a drawbar having enlarged ends, each of which is positioned in a socket formed in a railcar sill having outer side walls. A drawbar pin is retained in the sill and passes through an aperture in the enlarged drawbar end, retaining the drawbar in the socket. Pin bearing block means are carried in the drawbar and are in abutting relation with the pin. Slack adjusting wedge means urge the pin against the bearing block means. In accordance with this invention, the slack adjusting wedge means are positioned in the sill outer side walls. Thus, the slack adjusting wedge means can be inspected and maintained without disassembling the drawbar assembly.

16 Claims, 2 Drawing Sheets

SLACKLESS DRAWBAR

BACKGROUND OF THE INVENTION

Railway car drawbar assemblies and the like are frequently provided with slack adjustment and cushioning to protect the metal parts from the tremendous forces imposed upon them as fully loaded railroad cars accelerate and decelerate. See, for example, Payton U.S. Pat. No. 4,531,648, Altherr, U.S. Pat. No. 4,422,557, and Fishbaugh, U.S. Pat. No. 3,480,268. See also the abandoned U.S. patent application Ser. No. 577,228 of Carl B. McClurg et al, filed Feb. 6, 1984 and entitled Drawbars for Connecting Railcars, which discloses a prior art design of drawbar assembly which was built and tested by the assignee of this present application.

Existing drawbar assemblies slide laterally on the pin and jacknife when the system is in buff (i.e. when the railroad cars are decelerating). This motion causes high forces which wear and/or peen the existing sill structure of the railroad cars in such a manner that the condition worsens with use. This motion can cause the drawbar pin bearing block not to act in a purely radial relationship with the rear butt of the drawbar, thus causing extreme forces and metal flow in the pin bearing block, with resulting undesirable rapid wear.

Additionally, while existing drawbar assemblies have slack adjusting wedges within the sill to compensate for wear during operation, the wear condition of the parts and the amount of remaining possible slack adjustment cannot be determined in prior designs by casual inspection. Some designs of the prior art can be examined through small inspection holes in the sill, while others require examination from under the railroad car. If adjustment of the device is required, the slack adjustment wedges must be raised, the drawbar pin removed, and the railroad cars separated enough to put shims behind the follower blocks or slack adjusting wedge assemblies.

By this invention, the above described deficiencies of prior art devices are addressed with new and improved structure, to avoid the disadvantages of prior art drawbar assemblies, resulting in a structure which exhibits significantly improved wear characteristics, and greater ease of adjustability.

DESCRIPTION OF THE INVENTION

In this invention, a drawbar assembly is provided for interconnecting a pair of rail cars. Such an assembly comprises a drawbar having an enlarged end positioned in a socket formed in a railcar sill, with the railcar sill having outer side walls. A drawbar pin is retained in the sill, and passes through an aperture in the enlarged drawbar end to retain the drawbar in the socket.

Pin bearing block means are carried in the drawbar, and are positioned in abutting relation with the drawbar pin. Slack adjusting wedge means are also provided, urging the pin against the bearing block means to avoid the undesirable noise and damage provided by a loosely fitting system.

In accordance with this invention, the slack adjusting wedge means is positioned to be accessable through at least one of the sill outer side walls. As the result of this, the slack adjusting wedge means can be inspected with ease on a regular basis, and replaced or shimmed without disassembling the drawbar assembly. This provides a significant improvement in the ease and reliability of the maintenance program, as well as a significant reduction in the expense of railcar maintenance.

Preferably, the pin-bearing block means comprises a first bearing block which defines an arcuate recess which receives the drawbar pin in movable relation therewith. The first bearing block defines an arcuate face opposed to the recess, typically a convex, substantially spherical face. The arcuate face abuts a matching, arcuate face of a second bearing block, both of which are typically made of hardened metal, with the first bearing block being in rotationally slideable relation thereto, to reduce wear. The arcuate face of the second bearing block is typically concave, positioned in mating relation with the arcuate face of the first bearing block, with both faces being typically substantially spherical for free bearing movement relative to each other.

Elastomeric thrust washer means may be positioned laterally of the enlarged end of the drawbar, typically within the sill, to normally resiliently center the drawbar, and to permit motion of the drawbar on curves and to accommodate car body pitch and roll. However, in another embodiment of this invention, means for accomplishing this with means other than an elastomeric support member such as a thrust washer may be used.

Specifically, in such other embodiment, pin bearing block means as described above may define a typically vertical slot in generally perpendicular relation to the drawbar pin. The drawbar pin carries the projection which slidably fits into the vertical slot, to permit a limited amount of vertical rotational motion of the drawbar end about the drawbar pin. The bearing block means then has means permitting limited horizontal rotation of the drawbar, for example, by means of first and second bearing blocks as described above.

It also may be desirable to provide wear plate means carried within the drawbar end aperture, in abutting relation to and positioned above the drawbar pin. This wear plate means may be of hardened steel, harder than most of the rest of the drawbar, and serves the function of protecting the top of the drawbar end aperture from wear.

Each of the side walls may define an aperture of the shape of a horizontal T, to receive the drawbar pin in the area corresponding to the shank of the T, and to receive the slack adjusting wedge means in the area corresponding to the vertical crossbar of the horizontal T, thus providing extra room for the variable positioning of the slack adjusting wedge means.

DESCRIPTION OF SPECIFIC EMBODIMENTS

Figure 2:
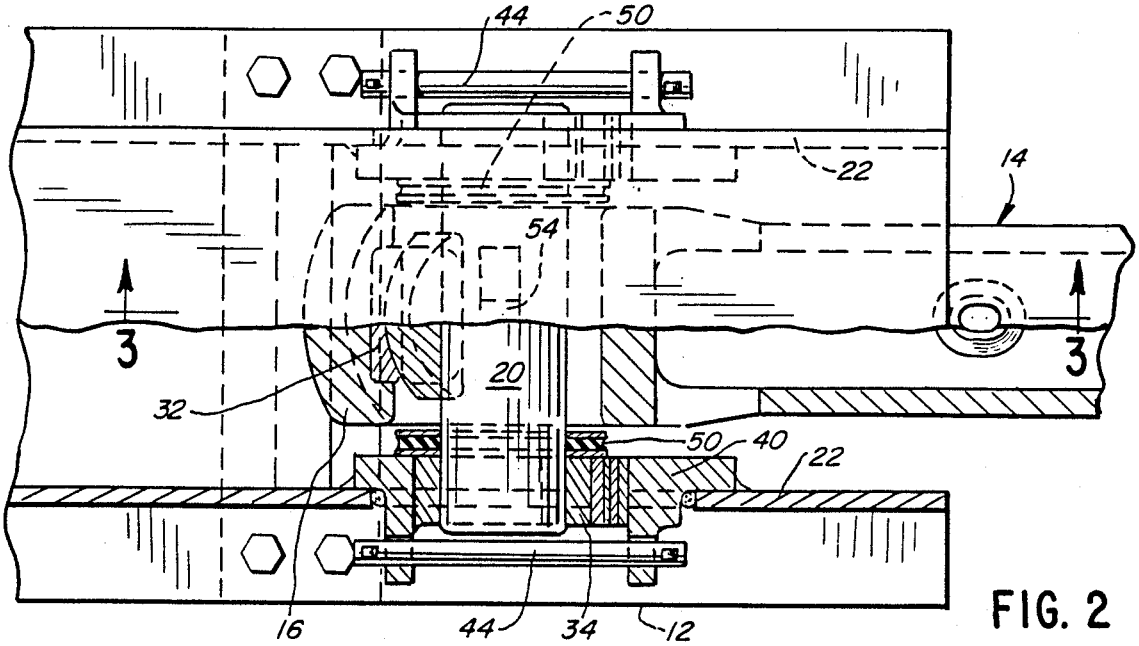
FIG. 2 is a plan view of the structure of FIG. 1, with portions broken away to show the structure partly in section.
Figure 3:
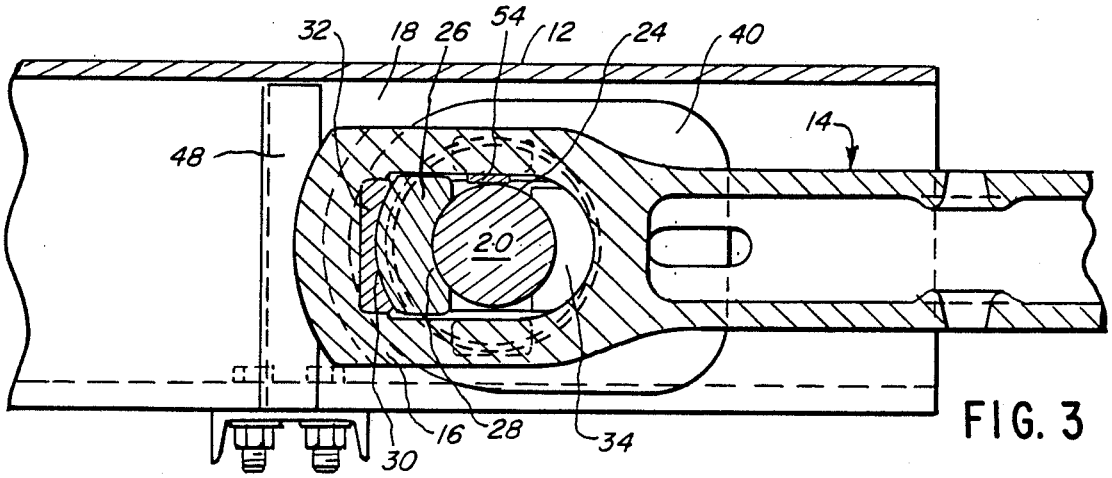
FIG. 3 is a sectional view taken along 3—3 of FIG. 2.
Figure 1:
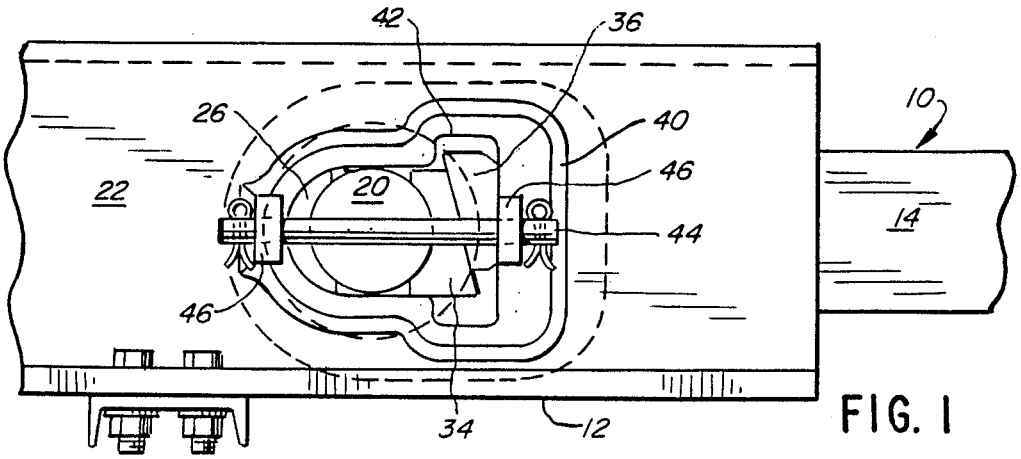
FIG. 1 is an elevational view of one embodiment of a drawbar assembly for interconnecting a pair of railcars.

Referring to FIGS. 1–3, a drawbar assembly 10 for interconnecting a pair of railcars is disclosed. Drawbar assembly 10 is positioned within a railcar sill 12 which may be of conventional design. Drawbar 14 defines an enlarged end 16 which is positioned in a socket 18 formed within sill 12. At its other end, drawbar 14 may have another enlarged end for similar connection to another railcar.

Drawbar pin 20 is disclosed, retained within the outer side walls 22 of sill 12 and passing through an aperture 24 in the enlarged end 16 of the drawbar, to retain drawbar within socket 18 of the sill.

As is conventional, a first pin bearing block 26 is carried within drawbar aperture 24 to provide bearing action with respect to drawbar pin 20 as the railcar travels. First bearing block 26 defines an arcuate, typically cylindrical recess 28 which receives drawbar pin 20 in movable relation therewith. In this particular embodiment, drawbar pin 20 is shown to be in intimate sliding bearing relation with cylindrical recess 28 of first bearing block 26.

In accordance with this invention, first bearing block 26 defines an arcuate face 30 which is opposed to recess 28. Arcuate face 30 abuts a matching, arcuate face of second bearing block 32. First and second bearing blocks 26, 32 may be made of hardened steel, while drawbar 14 is typically made of nonhardened steel. Second bearing block 32 is fixed in position within drawbar 14, permitting first bearing block 26 to move to a slight degree in bearing manner to accommodate motion by drawbar 14 as the railcar travels. By this, the wear at the related areas of drawbar 14 and drawbar pin 20 can be greatly reduced, because most of the moving bearing action is taken up by motion between first and second bearing blocks 26, 32.

Additionally, slack adjusting wedges 34, 36 are provided for functioning in conventional manner to keep drawbar pin 20 firmly pressed against first bearing block member 26. Wedge 36 urges wedge 34 by gravitational pressure into engagement with drawbar pin 20 to accomplish this purpose. It can be seen wedge 34 also serves as a bearing against drawbar pin 20.

Each sill sidewall 22 defines a cheek plate 40 which includes an aperture 42 of a shape of a horizontal T. It can be seen that drawbar pin 20 is positioned within the shank of the horizontal T, while the vertically directed crossbar of the T provides room for, particularly, slack adjusting wedge 36. It can also be seen that cheek plate 40 is symmetrical in shape and capable of being used on either side of the railcar.

In accordance with this invention, it can be seen that slack adjusting wedges 34, 36 are accessible through T-shaped aperture 42 in the cheek plates 40 of sill outer side walls 22, for inspection thereof. As wear continues, adjusting wedge 36 falls lower and lower toward and past a position of alignment with wedge 34. By the structure of this invention, simple observation can indicate when maintenance and repair of the system is required, without disassembly of the drawbar assembly. Furthermore, the slack adjusting wedges may be removed by the simple removal of retaining rod 44 from its retaining position within apertured blocks 46. Rod 44 normally retains drawbar pin 20 and adjusting wedges 34, 36 in their desired position. Thus, it becomes a greatly simplified matter to remove, repair, and replace the slack adjusting wedges in their relation with drawbar 20, without getting underneath the railcar and without significant added disassembly of the drawbar assembly.

As is conventional, the outer end of the head portion 16 of drawbar 14 abuts against follower block 48, which is retained within sill 12 and is positioned with close clearance of sill 12 so as to remain aligned within sill 12. Preferably, the clearance of follower block 48 is of no more than about 1/16 inch per side, (a total of ⅛ inch) to ensure proper alignment thereof. This, in turn, improves the situation when the railcar system is in buff, causing the drawbars to slide laterally and to jacknife in turn causing extreme forces and metal flow in the pin bearing block. The above described disposition of the follower block minimizes the above undesired effects.

Additionally in accordance with this invention, elastomeric thrust washers 50 are positioned laterally of the drawbar end, to resiliently center the drawbar, and to permit motion of the drawbar on curves and to accommodate car body pitch and body roll. As shown, thrust washer 50 comprise a ring of rubber, with metal plates positioned on each of the opposed major faces thereof. Thus, the drawbar can move in permitted ranges of motion, with bearing action taking place at bearing blocks 26, 32, but also the entire drawbar, including its interior components, can move to a certain extent through the resilient action of thrust washers 50. Thrust washers 50 may be bolted or the like to drawbar 14 and to cheek plate 40.

As an additional aspect of this invention, a small, hardened wear plate 54 may be carried within drawbar aperture 24 in abutting relation to and above drawbar pin 20. The effect of this hardened steel plate is to protect the top of the drawbar aperture 24 from undue wear.

Accordingly, a drawbar assembly is provided which has improved wear characteristics for greatly increased railcar mileage before replacement or repair is required. Additionally, the maintenance itself is greatly simplified by the outside accessibility provided in this invention to the slack adjusting wedges, so that they may be replaced or repaired without disassembling the drawbar assembly.

Figure 5:
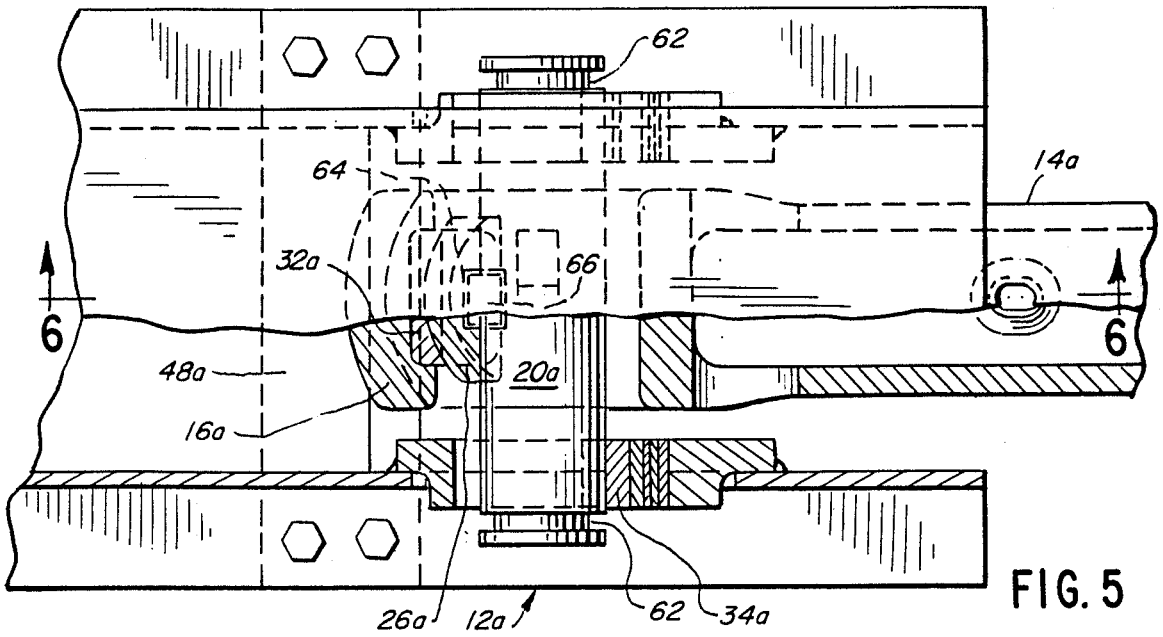
FIG. 5 is a plan view of the drawbar assembly of FIG. 4, with a portion thereof broken away to show portions of the device in section.
Figure 6:
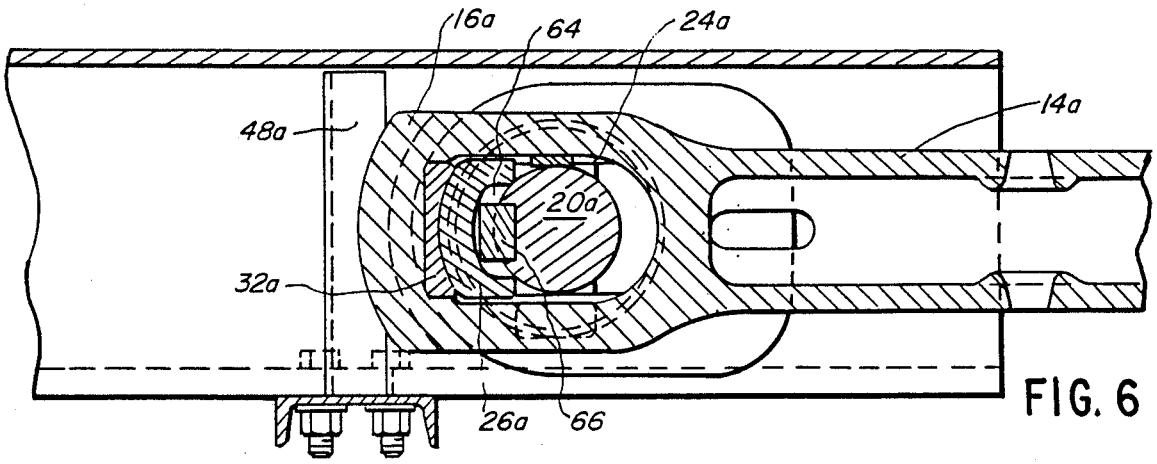
FIG. 6 is a sectional view taken along 6—6 of FIG. 5.
Figure 4:
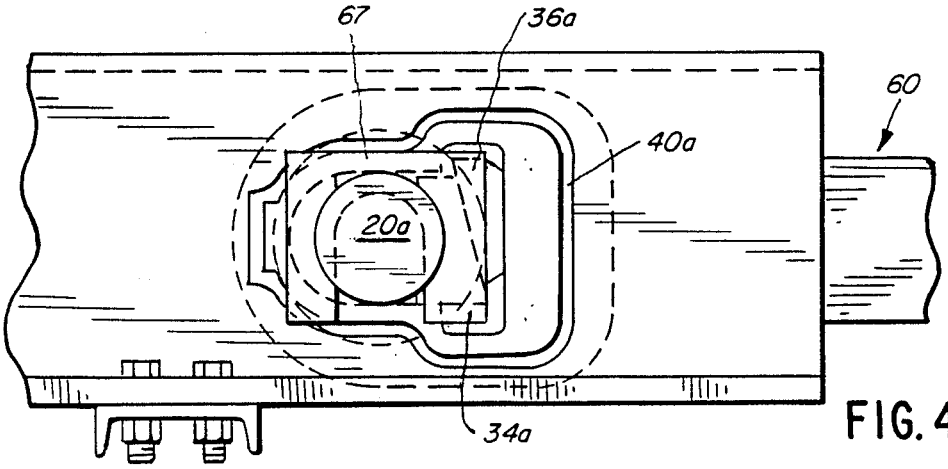
FIG. 4 is an elevational view of a second embodiment of a drawbar assembly for interconnecting a pair of railcars.

Turning now to FIGS. 4–6, another embodiment of drawbar assembly 60 is disclosed. As before, railcar sill 12*a* may be of a design similar to the sill of the previous embodiment. Drawbar 14*a* may be identical to the previous embodiment, having an enlarged end portion 16*a* which abuts against follower block 48*a* in conventional manner. Aperture 24*a* in the head of drawbar 14*a* is also conventional, and similar to the previous embodiment and slack adjusting wedges 34*a*, 36*a* are provided as before.

By way of distinction of this embodiment over the previous embodiment, while drawbar pin 20*a* is present to function in the same manner as before, it may define circumferential grooves 62 at the respective ends thereof. Thus, a keeper member 67 may be inserted into such grooves to cause retention of drawbar pin 20*a* in aperture 24*a*. As another alternative retention means, one may simply bolt a plate to each end of drawbar pin 20*a* for retention thereof, or any other desired retention means may be used as well.

In this invention, while first and second bearing blocks 26*a*, 32*a* are present and perform in a manner similar to the corresponding bearing blocks of the previous embodiment, first bearing block 26*a* defines a vertical slot 64 facing drawbar pin 20*a*. Drawbar pin 20*a*, in turn, carries a projection 66 which slidably fits into vertical slot 64, thus permitting limited vertical rotation of the drawbar, but restricting lateral motion at this point of the system.

Projection 66 may be a piece of metal dowel, welded or otherwise adhered into a notch in drawbar pin 20*a*, the axis of the dowel of projection 66 being substantially coaxial with that of the drawbar 14*a*. Horizontal motion of drawbar 14*a* may be accommodated by bearing action between bearing blocks 26*a*, 32*a*, and also by bearing action between the end of drawbar 14*a* and follower block 48*a*, to provide limited motion of drawbar 14*a* to accommodate for pitch, roll, and yaw of the moving railroad car.

Apart from the above, the corresponding parts are similar in structure to, and function in the same manner as, their analogs in the previous embodiment. For example, cheek plate 40*a* may be similar to the cheek plate 40 of the previous design, except that the blocks 46 of the previous design are not needed, since retention rod 44 has been eliminated.

The above has been offered for illustrative purposes only, and is not to be used to limit the scope of the invention of this application, which is as defined in the claims below.

That which is claimed is:

1. In a drawbar assembly for interconnecting a pair of railcars, said assembly comprising:

a drawbar having an enlarged end positioned in a socket formed in a railcar sill having outer sidewalls; a drawbar pin being retained in said sill and passing through an aperture in said enlarged drawbar end to retain said drawbar in the socket; pin bearing block means carried in said drawbar and abutting said pin; and slack adjusting wedge means urging said pin against said bearing block means, the improvement comprising, in combination:

each sidewall defining an aperture of the shape of a horizontal T to receive said drawbar in said slack adjusting wedge means, said slack adjusting wedge means positioned to be accessible through the sill outer side walls, whereby said slack adjusting wedge means can be inspected and replaced without disassembling the drawbar assembly.

2. The drawbar assembly of claim 1 in which said pin bearing block means comprises a first bearing block defining an arcuate recess which receives said drawbar pin in movable relation therewith, said first bearing block defining an arcuate face opposed to said recess, said arcuate face abutting a matching, arcuate face of a second bearing block, in rotationally slideable relation thereto, to reduce wear.

3. The drawbar assembly of claim 2 in which said first and second bearing blocks abut along a spherical surface.

4. The drawbar assembly of claim 1 in which elastomeric thrust washer means are positioned laterally of said drawbar enlarged end, to normally resiliently center said drawbar and to permit motion of the drawbar on curves and to accommodate car body pitch and roll.

5. The drawbar assembly of claim 1 in which wear plate means are carried within said drawbar end aperture in abutting relation to and positioned above said drawbar pin, to protect the top of said drawbar end aperture from wear.

6. The drawbar assembly of claim 1 in which said pin bearing block means defines a vertical slot facing said drawbar pin, said drawbar pin carrying a projection which slideably fits into said vertical slot, said bearing block means having means permitting limited vertical rotation of said drawbar.

7. The drawbar assembly of claim 6 in which said pin bearing block means comprises a first bearing block defining an arcuate recess which receives said drawbar pin in movable relation therewith, said first bearing block defining an arcuate face opposed to said recess, said arcuate face abutting a matching, arcuate face of a second bearing block in rotationally slideable relation thereto, to reduce wear.

8. The drawbar assembly of claim 7 in which said first and second bearing blocks abut along a spherical surface.

9. The drawbar assembly of claim 8 which is free of elastomeric support members.

10. The drawbar assembly of claim 8 in which wear plate means are carried within said drawbar end aperture in abutting relation to and positioned above said drawbar pin, to protect the top of said drawbar end aperture from wear.

11. A drawbar assembly for interconnecting a pair of railcars, said assembly comprising: a drawbar having an enlarged end positioned in a socket formed in a railcar sill having outer side walls; a drawbar pin retained in said sill and passing through an aperture in said enlarged drawbar end to retain said drawbar in the socket, pin bearing block means carried in said drawbar and abutting said pin, the improvement comprising, in combination: said pin bearing block means comprising a first bearing block positioned only on one side of said pin, said pin bearing block means defining an arcuate recess which receives said drawbar pin in movable relation therewith, said bearing block defining an arcuate face opposed to said recess, said arcuate face abutting a matching, arcuate face of a second bearing block in rotationally slidable relation thereto to reduce wear, said first and second bearing blocks abutting along a spherical surface, and wear plate means carried within said drawbar end aperture in abutting relation to end positioned above said drawbar pin to protect the top of said drawbar end aperture from wear, each drawbar being the shape of a horizontal T to receive said drawbar pin and said slack adjusting wedge means.

12. The drawbar assembly of claim 11 which includes slack adjusting wedges urging said pin against said bearing block means, said slack adjusting wedges means being positioned to be accessible through the sill outer side walls, whereby said slack adjusting wedges can be inspected and replaced without disassembling the drawbar assembly.

13. The drawbar assembly of claim 12 in which each of said side walls defines an aperture of the shape of a horizontal T to receive said drawbar pin and said slack adjusting wedge means.

14. In the drawbar assembly for interconnecting a pair of railcars, said assembly comprising: a drawbar having an enlarged end positioned in a socket formed in a railcar sill having outer side walls; a drawbar pin retained in said sill and passing through an aperture in said enlarged drawbar end to retain said drawbar in the socket; pin bearing block means carried in said drawbar and abutting said pin; and slack adjusting wedge means urging said pin against said bearing block means, the improvement comprising, in combination, said pin bearing block means defining a slot facing said drawbar pin, said drawbar pin carrying a projection which slideably fits into said slot to permit rotation of said drawbar in a first direction, said bearing block means having means permitting rotation of said drawbar in a direction perpendicular to said first direction.

15. The drawbar assembly of claim 14 in which said slack adjusting wedge means are positioned to be accessable through the sill outer side walls, whereby said slack adjusting wedge means can be inspected and replaced without disassembling the drawbar assembly, said pin bearing block means comprising a first bearing block defining an arcuate recess which receives said drawbar pin in movable relation therewith, said first bearing block defining an arcuate face opposed to said recess, said arcuate face abutting a matching, arcuate face of a second bearing block in rotationally slideable relation thereto, to reduce wear.

16. The drawbar assembly of claim 15 which is free of elastomeric support members.

* * * * *